US005795210A

United States Patent [19]

Kushner et al.

[11] Patent Number: 5,795,210

[45] Date of Patent: Aug. 18, 1998

[54] TOY BUILDING SET AND BUILDING ELEMENTS THEREFOR

[75] Inventors: Philip Marshall Kushner, Greve Strand; Kenn Rasmussen, Valby; Niels Øhrwald, Espergærde, all of Denmark

[73] Assignee: Interlego AG, Baar, Switzerland

[21] Appl. No.: 617,910

[22] PCT Filed: Sep. 21, 1994

[86] PCT No.: PCT/DK94/00353

§ 371 Date: Mar. 19, 1996

§ 102(e) Date: Mar. 19, 1996

[87] PCT Pub. No.: WO95/08376

PCT Pub. Date: Mar. 30, 1995

[30] Foreign Application Priority Data

Sep. 22, 1993 [DK] Denmark ..... 1064/93

[51] Int. Cl.[6] ..... A63H 33/08; A63H 33/04

[52] U.S. Cl. ..... 446/128; 446/124; 446/117

[58] Field of Search ..... 446/128, 126, 446/125, 124, 120, 121, 117, 91, 85

[56] References Cited

U.S. PATENT DOCUMENTS

| | | | |
|---|---|---|---|
| 3,442,044 | 5/1969 | Quercetti | 446/124 |
| 4,744,780 | 5/1988 | Volpe | 446/128 |
| 5,022,885 | 6/1991 | Lyman | 446/125 X |
| 5,259,803 | 11/1993 | Lyman | 446/128 |

FOREIGN PATENT DOCUMENTS

| | | | |
|---|---|---|---|
| 1256070 | 2/1961 | France | 446/128 |
| 1051087 | 12/1966 | France | 446/128 |
| 2429491 | 1/1975 | Germany | 446/128 |
| 3327957 | 2/1985 | Germany | 446/120 |
| 226906 | 7/1969 | Sweden . | |
| 345809 | 6/1972 | Sweden . | |
| 2118447 | 11/1983 | United Kingdom . | |

*Primary Examiner*—Robert A. Hafer
*Assistant Examiner*—D. Neal Muir
*Attorney, Agent, or Firm*—Kane, Dalsimer, Sullivan, Kurucz, Levy, Eisele and Richard, LLP

[57] ABSTRACT

A toy building set has building elements which can be interconnected in a releasable frictional engagement. The building set comprises building elements having a first type of coupling means arranged in a two-dimensional modular pattern, and building elements having a coupling means of a second type dimensioned to touch coupling means of the first type. The building set moreover comprises building elements having a third type of coupling means, which are arranged in the two-dimensional modular pattern, but offset with respect to coupling means of the first type and dimensioned not to touch coupling means of that type, as well as building elements having at least one coupling means of a fourth type dimensioned to touch coupling means of the third type. Further, building elements for the building set are described.

17 Claims, 4 Drawing Sheets

TOY BUILDING SET AND BUILDING ELEMENTS THEREFOR

BACKGROUND OF THE INVENTION

1. Field of the Invention

The invention concerns a toy building set with building elements which can be built together in a releasable frictional engagement, comprising building elements which have a first type of coupling studs arranged in a two-dimensional modular pattern, and building elements which have at least a second type of coupling stud dimensioned to touch coupling studs of the first type, and moreover building elements for such a toy building set.

2. Description of the Prior Art

Such toy building sets and building elements therefor are available in many different embodiments, wherein the coupling studs of the first type either have a circular or polygonal cross-section and are arranged on a face so as to form a two-dimensional modular pattern. The modular pattern frequently consists of a first type of coupling studs arranged in rows at right angles to each other and equidistantly spaced in the directions of the rows. This spacing is here called the modular measure or modular spacing. The prior art also includes toy building sets wherein coupling studs are arranged in rows forming angles of 60° with each other. Such known building elements are frequently in the form of a right-angled box, two or more building elements being interconnected by means of elements having a second type of coupling means which are complementary to the first type of coupling studs, and which are adapted for interconnection by a releasable frictional engagement. The known coupling means of the second type comprise a tubular coupling stud, which is dimensioned to touch a plurality of coupling studs of the first type. Danish patent 92683 describes such building elements.

SE-C1-226 906 shows a toy building set in which elements have a first type of coupling studs for interconnection with other building elements having a second type of coupling studs. The second type of coupling studs comprise the side walls of the elements and studs of tubular, cruciform and other shapes for engaging the studs of the first type.

GB-A-2 118 447 shows a toy building set with building elements having coupling studs for interconnection with other elements by receiving the studs in a cavity. One cavity can receive either one large stud or four small studs on another building element.

SUMMARY OF THE INVENTION

There is a wish for a toy building set in which the coupling force between interconnected building elements is greater than in the known toy building sets. Coupling force is here taken to mean the frictional force between the respective coupling studs of two interconnected building elements, by means of which the building elements are retained with respect to each other, and which is to be overcome when the building elements are interconnected and separated. Of course, an increased coupling force may be obtained with larger building elements, the number of the coupling studs and thus their contact area being correspondingly increased. However, this solution takes up much space and is not always expedient, because such a new toy building set should simultaneously be compatible with the known toy building sets, so that any building element from the new toy building set must be capable of being connected with any building element from the known toy building sets to achieve the known coupling force. This wish is fulfilled with a toy building set as defined in claim 1 and with toy building elements as defined in claims 11 and 15, respectively.

The toy building set of claim 1 thus comprises building elements having four different types of coupling studs, the first and second types of which being present on known building elements, while the third and fourth types of coupling studs are new.

Claims 11 and 15 define independent building elements according to the invention. When a building element according to claim 11 is connected with a building element according to claim 15, the desired increased coupling force is achieved. Simultaneously, each of these building elements is fully compatible with the known building elements as defined in the introductory portion of claim 1, and the known coupling force is achieved when these building elements of the invention are interconnected with known building elements.

BRIEF DESCRIPTION OF THE DRAWINGS

The invention will be described more fully below with reference to the drawing, in which.

DESCRIPTION OF THE PREFERRED EMBODIMENTS

Figure 1:
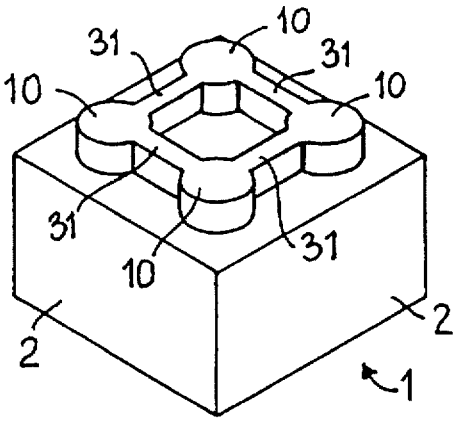
FIG. 1 is a perspective top view of a building element according to the invention.
Figure 2:
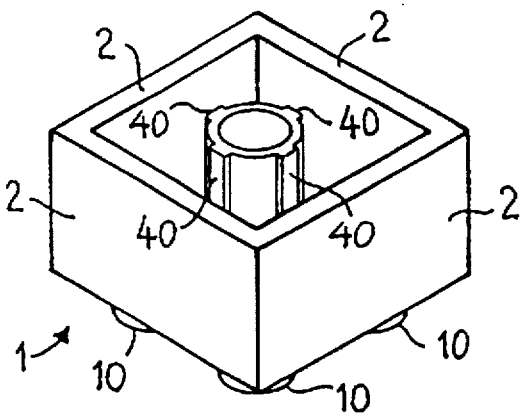
FIG. 2 is a perspective bottom view of the building element of FIG. 1.
Figure 3:
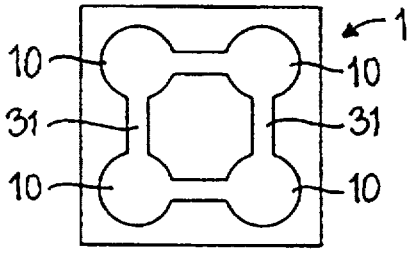
FIG. 3 is a top view of the building element of FIG. 1.

FIGS. 1–4 show a building element 1 in the form of a right-angled box having vertical side walls 2 and a square horizontal cross-section. The bottom of the element is open. The upper side of the building element 1 has four cylindrical projections 10 which are arranged with their centres in the corners of a square. Between each adjacent pair of cylindrical projections 10, the building element 1 has projecting intermediate members 31 which connect cylindrical adjacent projections 10 in pairs.

Interiorly, the building element 1 has a tube 20 which extends from the center of the interior upper side down to the level of the lower edges of the walls 2. In positions directed outwards toward the four outer walls 2 of the element, the tube 20 has four vertically extending, projecting ribs 40.

Figure 10:
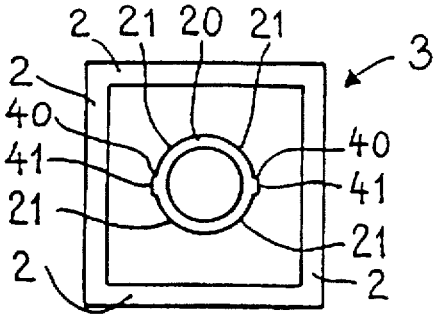
FIG. 10 is a bottom view of an alternative embodiment of a building element according to the invention.

FIG. 10 shows a building element 3 which, like the building element 1, has walls 2 and an interior tube 20 having projecting ribs 40 in just two diametrically opposite positions with respect to the outer wall 2. The element 3 in FIG. 10 differs from the element 1 only in that its tube 20 just has two ribs 40, whereas the element 1 has four ribs.

Figure 15:
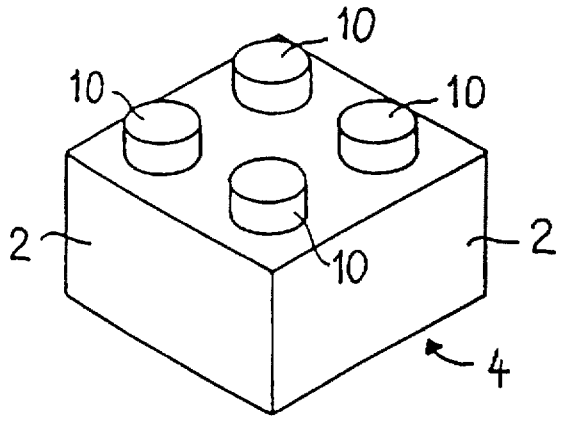
FIG. 15 PRIOR ART
FIG. 15 is a perspective top view of a known building element.
Figure 16:
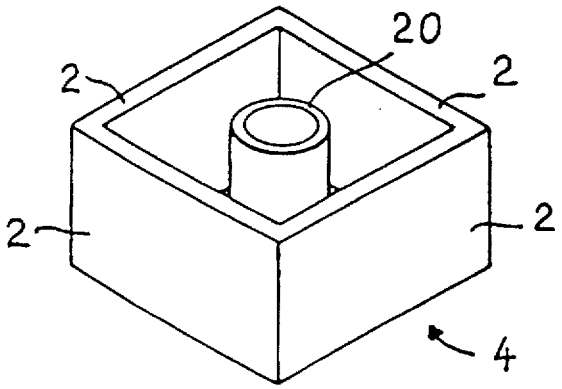
FIG. 16 PRIOR ART
FIG. 16 is a perspective bottom view of the building element of FIG. 15.

FIGS. 15 and 16 show a known building element 4 with the same box shape as the elements 1 and 3. Its upper side is provided in a known manner with cylindrical projections 10 without intermediate projections between adjacent pairs of projections 10. Interiorly, the element has a tube 20 of circular-cylindrical shape.

The cylindrical projections 10 on the building element 4 serve as a first type of coupling means, and the cylindrical tube 20 serves as a second type of coupling means, and the two building elements 4 may be interconnected in a known manner by placing them on top of each other. Thus, the first type of coupling means consisting of the cylindrical projections 10 on one of the building elements will thus be received in the hollow bottom of the second building element. The cylindrical projections 10 will then be in contact with the inner side of the walls 2 and with the outer side of the cylindrical tube 20 on the other building element, and the cylindrical tube 20 then serves as a second type of coupling means. The shown building element 4 here has both the first type of coupling means consisting of the projections 10 and the second type of coupling means consisting of the tube 20. Thus, when building elements 4 are interconnected, the tube 20 contacts four projections 10, which gives four points of contact on the tube 20.

Figure 4:
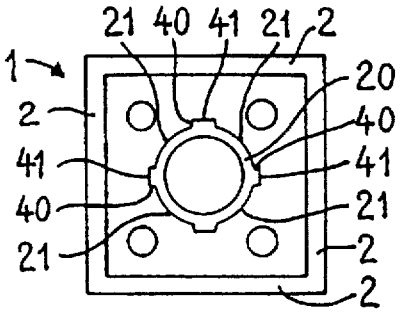
FIG. 4 is a bottom view of the building element of FIG. 1.
Figure 5:
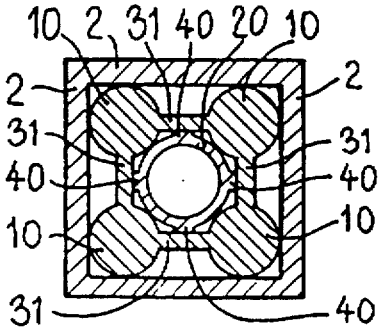
FIG. 5 is a sectional view of interconnected building elements according to the invention along the line V—V in FIG. 6.
Figure 6:
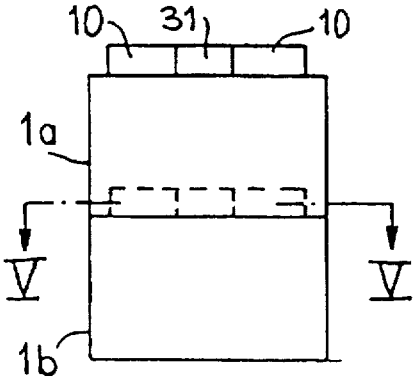
FIG. 6 is a lateral view of two interconnected building elements according to the invention.

It is shown in FIGS. 5 and 6 how a building element 1*a* is built on top of a building element 1*b*, both of which are of the type shown in FIGS. 1–4. The cylindrical projections 10 and the projections 31, which connect the projections 10 in pairs, are here seen to define a first type of coupling means and a third type of coupling means, respectively, each of said projections having a coupling function by cooperation with corresponding coupling means on the building element 1*a*. The building element 1*a* touches each of the cylindrical projections 10 on the building element 1b with the inner side of its walls 2, so that these walls 2 provide a coupling force upon the engagement with the cylindrical projections 10. Further, the cylindrical tube 20 of the building element 1*a* contacts each of the cylindrical projections 10 on the building element 1*b* with its outer surface. Like the known building element 4 in FIGS. 15–16, the cylindrical projections 10 on the building elements 1 and 1*b* constitute a first type of coupling studs, and similarly the cylindrical tube 20 constitutes a second type of coupling studs in a known manner.

It is moreover apparent from FIG. 5 that the projections 31 on the building element 1*b* constitute a third type of coupling means, said projections 31 being in contact with the ribs 40 on the outer side of the cylindrical tube 20 of the building element 1*a*. The ribs 40 thus constitutes a fourth type of coupling means.

FIG. 4 shows coupling positions 21 on the tube 20 at which the tube 20, in the connected state, is in contact with the cylindrical projections 10, and moreover shows coupling positions 41 on the ribs 40 at which the ribs 40 are in contact with the projections 31. It will be seen that the coupling tube 20 with its ribs 40, when connected with a building element with projections 10 and 31, has eight coupled positions 21 and 41, which results in an increased coupling force over the building elements 4 in FIGS. 15 and 16.

Figure 7:
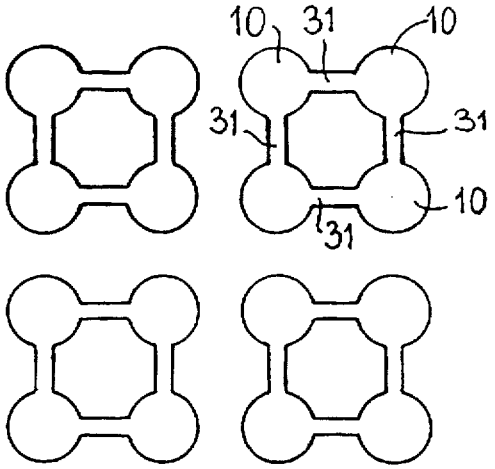
FIG. 7 shows a first embodiment of the coupling means of the third type on a building element according to the invention.
Figure 8:
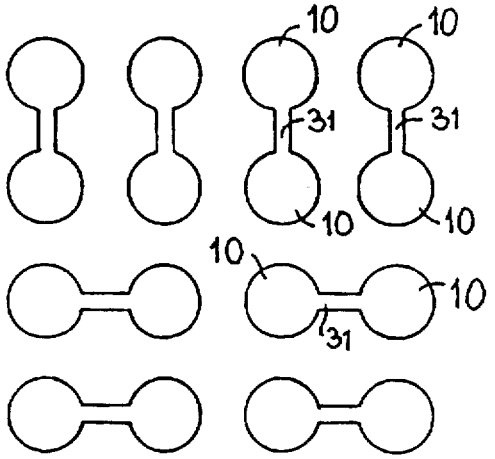
FIG. 8 shows a second embodiment of the coupling means of the third type on a building element according to the invention.
Figure 9:
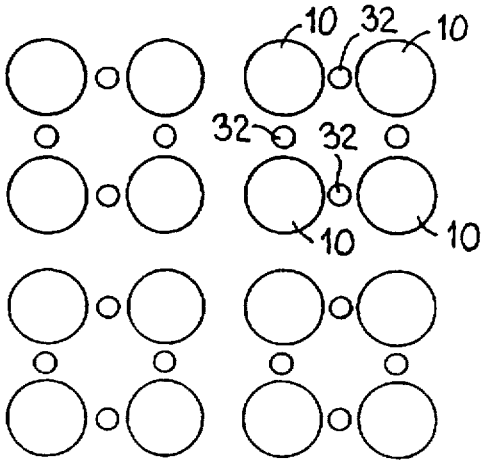
FIG. 9 shows a third embodiment of the coupling means of the third type on a building element according to the invention.

FIGS. 7, 8 and 9 show coupling means of the first type and three different embodiments of coupling studs of a third type on a building element according to the invention, e.g. a building plate.

Four cylindrical projections 10 arranged in a square are connected in pairs by projections 31 in FIG. 7 in the same manner as on the building element 1 in FIGS. 1–4 so as to create a pattern which is repeated in two dimensions.

FIG. 8 shows another embodiment of the cylindrical projections 10 of the first type and the projections 31 of the third type. Here there are just half as many projections 31 as in FIG. 7. Here too, each of the projections 31 is arranged in spaces between adjacent pairs of cylindrical projections 10. Also this pattern may be varied, since, as shown, projections 31 may be provided between pairs of projections 10 in both dimensions. Each of the projections 31 is contiguous with two projections 10 in FIG. 7 as well as in FIG. 8.

FIG. 9 shows a third embodiment of the third type of coupling studs. In the same manner as in FIG. 7, independent projections 32 are provided between adjacent pairs of cylindrical projections 10 in FIG. 9; the projections 32 are cylindrical here, but may have any other shape which is suitable for the purpose, and also the projections 32 serve as coupling studs of the third type. Less material is to be used in FIG. 9 in relation to the embodiment in FIG. 7.

FIG. 10 shows a building element 3 of square horizontal section and vertical walls 2. The element 3 has a cylindrical tube 20, projecting ribs 40 being provided in two diametrically opposite positions. In contrast to the building element 1 in FIGS. 1–6, the building element 3 just has two ribs 40.

Figure 11:
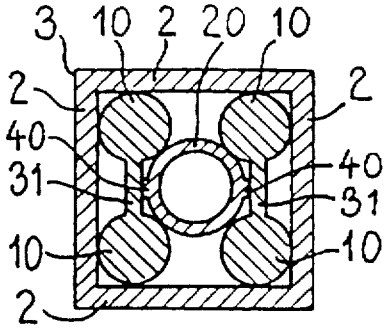
FIG. 11 shows the building element of FIG. 10 connected with a second building element according to the invention in the same manner as in FIG. 5.
Figure 12:
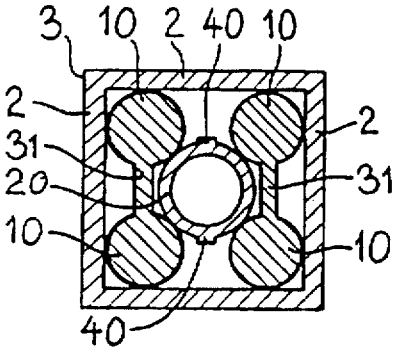
FIG. 12 shows the same interconnected building elements as in FIG. 11 in an alternative connected position.

It is shown in FIGS. 11 and 12 how the building element 3 may be coupled with another building element having coupling studs 10 and 31 arranged like in FIG. 8. In FIG. 11, both projections 40 on the tube 20 of the element 3 are in contact with a projection 31. Further, the cylindrical tube 20 and the walls 2 are in contact with the four cylindrical projections 10. The contact between the ribs 40 and the projections 31 here gives an increased coupling force over the known building elements of FIGS. 15–16, since the tube 20 with the ribs 40 has six coupling positions 21, 41 in contact with the coupling studs 20 and 31 of the other building element.

FIG. 12 shows an alternative assembly of the two building elements of FIG. 11. In FIG. 12, the building element 3 has been rotated 90° with respect to the position in FIG. 11, and it will be seen that the ribs 40 and the projections 31 are no longer in contact with each other or with any other structure on the respective other building element. In FIG. 12, the contact between the two interconnected building elements exclusively takes place in a known manner in that the four walls 2 and the tube 20 are in contact with the cylindrical projections 10, thereby providing the ordinary coupling force, as is the case with the elements 4 in FIG. 15–16.

Thus, with one and the same building element 3 the user may thus choose between having the known coupling force like in FIG. 12 or an increased coupling force like in FIG. 11.

Figure 13:
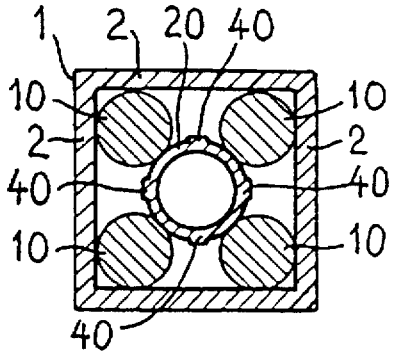
FIG. 13 shows a building element according to the invention connected with a known building element in sectional view in the same manner as in FIG. 5.

In FIG. 13, a building element 1, like in FIGS. 1–4, is built on top of a known building element 4 like in FIG. 15. The building element 1 is in contact with the four cylindrical projections 10 on the building element 4 with its walls 2 and the tube 20, while the projections 40 on the cylindrical tube 20 are not in contact with the building element 4. Thus, in the same manner as with known building elements 4, the tube 20 contacts the cylindrical projections 10 with just four points of its surface, resulting in the known coupling force.

Figure 14:
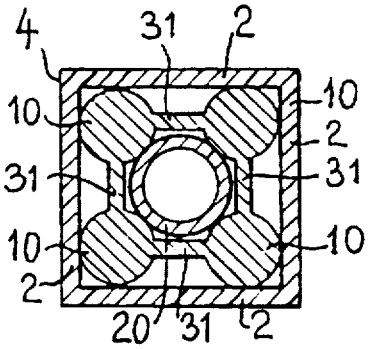
FIG. 14 shows a building element according to the invention connected with a known building element in sectional view in the same manner as in FIG. 5.

It is shown in FIG. 14 how a known building element 4 like in FIG. 16 is built on top of a building element 1 like in FIGS. 1–4. The known building element 4 is in contact with the cylindrical projections 10 on the building element 1 with its walls 2 and its cylindrical tube 20. The tube 20 on the known building element 4 has no ribs on the outer side, and therefore there is no contact between the tube 20 and the four projections 31 on the building element 1. Here too, the tube 20 is just in contact with the four cylindrical projections, and the known coupling force is obtained here too.

All of the building elements mentioned here have at least coupling studs of the first type, viz. the cylindrical projections 10, and at least one coupling stud of the second type, viz. the tube 20. According to the invention, some of the building elements moreover have a third type of coupling studs, viz. the projections 31 or 32, yet other building elements have a fourth type of coupling means, viz. the ribs 40 on the tube 20.

Interconnection of building elements where one building element has coupling studs of the third type and the other building element has coupling studs of the fourth type, results in the desired increased coupling force, while interconnection of building elements which do not have coupling means of the third type or the fourth type, always results in the known coupling force, no matter whether they are connected with building elements which have coupling means of the third type or the fourth type, or whether they just have known coupling means of the first and second types.

It is noted that the known building elements in FIGS. 15 and 16 have coupling means of both the first type and the second type, and the building element in FIGS. 1–4 has coupling means of all four types. As stated in claim 11, there may also be building elements which just have coupling means of the first type and the third type, and, as defined in claim 15, building elements which just have coupling means of the second type and the fourth type; however, such building elements can only be connected with a single other building element.

We claim:

1. A toy building set with building elements (1, 3, 4) capable of being interconnected in a releasable frictional engagement, and comprising building elements which have a first type of coupling means (10) arranged in a two dimensional modular pattern, and building elements which have at least one coupling means (2, 20) of a second type which is so dimensioned that when a building element having coupling means (10) of the first type is interconnected with a building element having a coupling means (2, 20) of the second type, the coupling means (2, 20) of the second type will touch the coupling means (10) of the first type in a releasable frictional engagement, wherein the building set moreover comprises building elements which have a third type of coupling means (31, 32) arranged in the two-dimensional modular pattern and offset with respect to coupling means (10) of the first type, the third type of coupling means (31, 32) being so dimensioned that when a building element having coupling means (2, 20) of the second type is interconnected with a building element having coupling means (10) of the first type and coupling means (31, 32) of the third type, the coupling means (2, 20) of the second type will not touch the coupling means (31, 32) of the third type, and building elements which have at least one coupling means (40) of a fourth type which is so dimensioned that when a building element having coupling means (31, 32) of the third type is interconnected with a building element having the coupling means (40) of the fourth type, the coupling means (31, 32) of the third type will touch the coupling means (40) of the fourth type in a releasable frictional engagement.

2. A toy building set according to claim 1, wherein coupling means (31, 32) of the third type are provided in spaces between adjacent pairs of coupling means (10) of the first type.

3. A toy building set according to claims 1–2, wherein coupling means (31, 32) of the third type are non-contiguous with coupling means (10) of the first type.

4. A toy building set according to claims 1–2, wherein coupling means (31, 32) of the third type are contiguous with coupling means (10) of the first type.

5. A toy building set according to claim 1, wherein the coupling means of the second type comprise means (2) adapted to circumscribe and touch the coupling means (10) of the first type in said releasable frictional engagement.

6. A building element for use in a toy building set according to claim 5, comprising coupling means (10) of the first type arranged in the two-dimensional modular pattern, coupling means (2, 20) of the second type for releasable frictional engagement with coupling means (10) of the first type on another building element of the building set, and coupling means (40) of the fourth type arranged in a predetermined, fixed relationship with the second type of coupling means (2, 20) on the building element, wherein when the second type of coupling means (2) on another building element of the building set circumscribes and touches the coupling means (10) of the first type in said releasable frictional engagement, the coupling means (40) of the fourth type will not touch the coupling means (10) of the first type.

7. A building element according to claim 6 wherein the second type of coupling means (2) has a circular-cylindrical outer surface and wherein the fourth type of coupling means (40) are provided as projections on said surface.

8. A building element according to claim 6 wherein the second type of coupling means (2, 20) is tubular.

9. A toy building set according to claim 1, wherein the coupling means of the second type comprise means (20) having a surface with a circular-cylindrical outer shape adapted to touch coupling means (10) of the first type in said releasable frictional engagement.

10. A toy building set according to claims 5–9, wherein coupling means (20) of the second type have a surface with a circular-cylindrical shape (20) dimensioned to touch coupling means (10) of the first type and coupling means (40) of the fourth type are projections (40) on the cylindrical surface dimensioned to touch coupling means (31, 32) of the third type.

11. A toy building set according to claims 1, 2, 5 or 9, wherein the coupling means (20) of the second type are tubular.

12. A toy building set according to claims 1, 2, 5 or 9, comprising building elements which each have coupling means of at least two of the said types.

13. A building element for use in a toy building set according to claim 5 comprising:

coupling means (10) of the first type arranged in the two-dimensional modular pattern, coupling means (2, 20) of the second type for releasable frictional engagement with coupling means (10) of the first type on another building element of the building set, and coupling means (31, 32) of the third type arranged in a predetermined, fixed relationship with the first type of coupling means (10) on the building element, wherein when the second type of coupling means (2) on another building element of the building set circumscribes and touches the coupling means (10) of the first type in said releasable frictional engagement, the coupling means (31, 32) of the third type will not touch the coupling means (2, 20) of the second type.

14. A building element according to claim 13, wherein coupling means (31, 32) of the third type are provided in spaces between adjacent pairs of coupling means (10) of the first type.

15. A building element according to claim 13 wherein coupling means (32) of the third type are non-contiguous with coupling means (10) of the first type.

16. A building element according to claim 13, wherein coupling means (31) of the third type are contiguous with coupling means (10) of the first type.

17. A building element according to claim 13 wherein the second type of coupling means (2, 20) is tubular.

* * * * *